US008661579B2

(12) United States Patent
Orrico et al.

(10) Patent No.: US 8,661,579 B2
(45) Date of Patent: Mar. 4, 2014

(54) PATIENT TRANSFER

(76) Inventors: James P. Orrico, Chicago, IL (US); Mario M. Orrico, Chicago, IL (US)

( * ) Notice: Subject to any disclaimer, the term of this patent is extended or adjusted under 35 U.S.C. 154(b) by 780 days.

(21) Appl. No.: 12/739,907

(22) PCT Filed: May 29, 2009

(86) PCT No.: PCT/US2009/045581

§ 371 (c)(1),
(2), (4) Date: Apr. 26, 2010

(87) PCT Pub. No.: WO2010/019306

PCT Pub. Date: Feb. 18, 2010

(65) Prior Publication Data

US 2010/0251480 A1 Oct. 7, 2010

Related U.S. Application Data

(60) Provisional application No. 61/188,675, filed on Aug. 12, 2008, provisional application No. 61/196,463, filed on Oct. 17, 2008, provisional application No. 61/210,265, filed on Mar. 17, 2009.

(51) Int. Cl.

| | |
|---|---|
| ***A61G 5/00*** | (2006.01) |
| ***A61G 5/12*** | (2006.01) |
| ***A61G 7/10*** | (2006.01) |
| ***A47C 1/00*** | (2006.01) |

(52) U.S. Cl.
USPC ..... 5/81.1 R; 5/81.1 RP; 5/83.1; 5/86.1; 5/87.1; 297/325

(58) Field of Classification Search
USPC ..... 5/81.1 R, 83.1–89.1, 81.1 RP; 297/325, 297/DIG. 10
See application file for complete search history.

(56) References Cited

U.S. PATENT DOCUMENTS 2,565,536 A * 8/1951 Valentine ..... 5/84.1
3,394,933 A 7/1968 Benoit (Continued)

FOREIGN PATENT DOCUMENTS

JP 09000570 A 7/1997
WO WO2006099391 9/2006
WO WO 2007138175 A1 * 12/2007

OTHER PUBLICATIONS

Disability Warehouse, Rota Stand, http://www.disability-warehouse.co.uk/product/rota-stand, Aug. 6, 2013, pp. 1-2.

(Continued)

*Primary Examiner* — William Kelleher
*Assistant Examiner* — Eric Kurilla
(74) *Attorney, Agent, or Firm* — Robert J. Brill; Brill IP Law Office

(57) ABSTRACT

An apparatus in an example comprises a seat, a torso support, and a connector. The seat comprises a rigid core. The torso support is coupled with the seat. The connector is coupled with the seat and/or the torso support. The connector is removably connectable with an accessory that serves to at least in part support a weight of a patient relative to a load-bearing surface. A location of the patient on the seat with a front of the patient faced toward the torso support and the connector coupled with the accessory allows control by a caregiver of an upper body of the patient for and during transfer of the patient by the caregiver from a start location to a target location.

16 Claims, 14 Drawing Sheets

(56) References Cited

U.S. PATENT DOCUMENTS

| | | | | | |
|---|---|---|---|---|---|
| 3,940,808 | A | * | 3/1976 | Petrini | 5/83.1 |
| 3,967,329 | A | * | 7/1976 | Whitton et al. | 5/81.1 R |
| 3,996,632 | A | * | 12/1976 | Bakker nee Viel | 5/83.1 |
| 4,157,593 | A | | 6/1979 | Kristensson | |
| 4,232,412 | A | * | 11/1980 | Petrini | 5/83.1 |
| 4,435,863 | A | | 3/1984 | Lerich | |
| 4,484,366 | A | * | 11/1984 | Koontz | 5/83.1 |
| 4,510,633 | A | * | 4/1985 | Thorne | 5/87.1 |
| 4,569,094 | A | * | 2/1986 | Hart et al. | 5/87.1 |
| 4,644,595 | A | * | 2/1987 | Daniel | 5/83.1 |
| 4,700,415 | A | * | 10/1987 | DiMatteo et al. | 5/88.1 |
| 4,704,749 | A | * | 11/1987 | Aubert | 5/87.1 |
| 4,829,612 | A | * | 5/1989 | Adams | 5/81.1 RP |
| 4,934,003 | A | | 6/1990 | Hayakawa | |
| 5,090,072 | A | | 2/1992 | Gray | |
| 5,384,922 | A | * | 1/1995 | Jobe | 5/81.1 RP |
| 5,502,851 | A | * | 4/1996 | Costello | 5/86.1 |
| 5,526,541 | A | * | 6/1996 | Massey et al. | 5/81.1 RP |
| 5,711,044 | A | | 1/1998 | Newman | |
| 6,058,527 | A | * | 5/2000 | Charpin | 5/81.1 RP |
| 6,119,287 | A | * | 9/2000 | Phillips | 5/81.1 RP |
| 6,276,007 | B1 | * | 8/2001 | Brown | 5/81.1 R |
| 6,457,196 | B1 | * | 10/2002 | Dykes et al. | 5/655 |
| 6,581,222 | B1 | * | 6/2003 | Liljedahl | 5/89.1 |
| 6,832,770 | B1 | * | 12/2004 | Wright-Ott et al. | 280/87.041 |
| 6,961,967 | B1 | * | 11/2005 | Brown | 5/81.1 R |
| 7,165,276 | B2 | * | 1/2007 | Hahn et al. | 5/81.1 RP |
| 7,191,477 | B2 | * | 3/2007 | Hahn et al. | 5/81.1 RP |
| 7,340,784 | B2 | * | 3/2008 | Stryker et al. | 5/81.1 HS |
| 7,540,045 | B2 | * | 6/2009 | Nativ | 5/86.1 |
| 7,543,341 | B1 | * | 6/2009 | Carbaugh | 5/81.1 RP |
| 7,578,012 | B2 | * | 8/2009 | Palay et al. | 5/81.1 R |
| 7,984,524 | B1 | * | 7/2011 | Haessly | 5/662 |
| 8,171,587 | B1 | * | 5/2012 | Haessly | 5/662 |
| 8,250,687 | B2 | * | 8/2012 | Spidare et al. | 5/87.1 |
| 2002/0104160 | A1 | * | 8/2002 | Kammeyer | 5/81.1 R |
| 2005/0268397 | A1 | * | 12/2005 | Nativ | 5/86.1 |
| 2006/0097557 | A1 | * | 5/2006 | Tholkes et al. | 297/330 |
| 2006/0213007 | A1 | * | 9/2006 | Palay et al. | 5/81.1 R |
| 2009/0158523 | A1 | | 6/2009 | Burak, Jr. | |
| 2009/0249544 | A1 | | 10/2009 | Palay | |
| 2009/0276955 | A1 | * | 11/2009 | Palay et al. | 5/87.1 |

OTHER PUBLICATIONS

Handy Healthcare, Turn Safe Disc, http://handyhealthcare.co.uk/turn-safe-disc.html, Aug. 6, 2013, pp. 1.

Rand-Scot, EasyPivot Patient Lift, http://randscot.com/lifts, Aug. 6, 2013, pp. 1.

* cited by examiner

PATIENT TRANSFER

DESCRIPTION OF THE DRAWINGS

Features of exemplary implementations of the invention will become apparent from the description, the claims, and the accompanying drawings in which:

DETAILED DESCRIPTION

Figure 1:
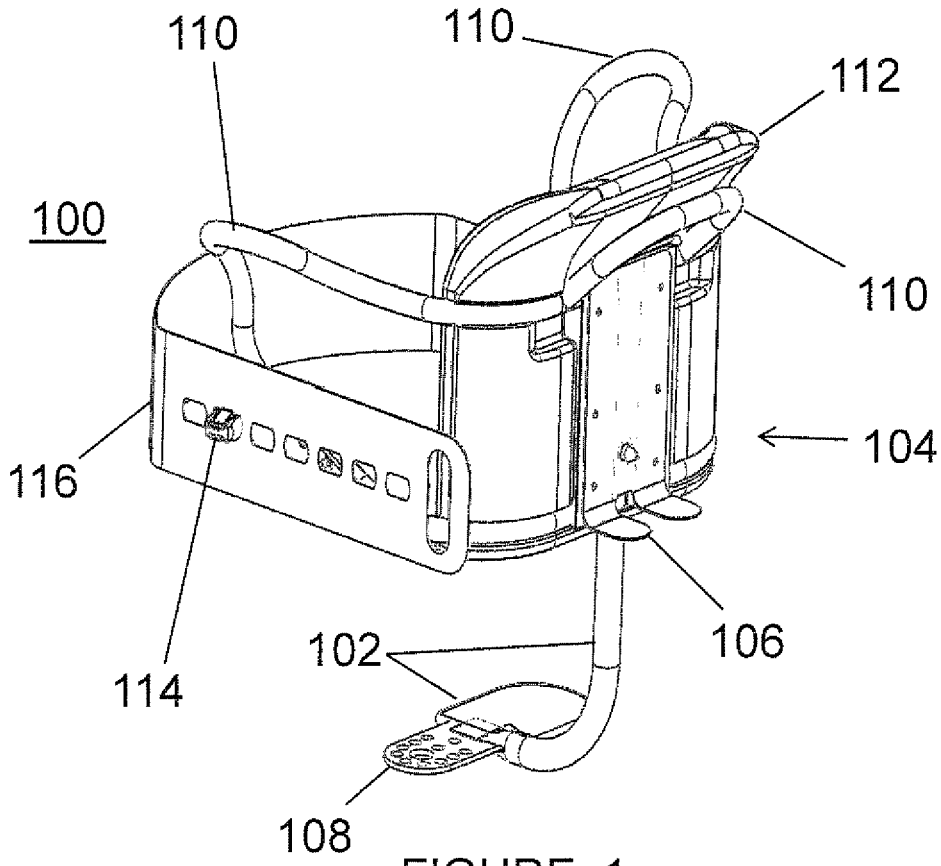
FIG. 1 is a rear, side, perspective representation of an implementation of an apparatus that interfaces with a patient for control of an upper body of the patient for transfer by a caregiver of the patient as in FIGS. 11 and 12, where the apparatus comprises a seat, a torso support, and a connector, with a partial cutaway representation of the seat illustrating a rigid core of the seat.

A person may need assistance in transferring the person's body from one location to another, for example, because of a disability caused by injury, disease, or the natural aging process. Relatively high rates of injury may result for one or more caregivers who manually perform the transfer of a disabled person. Such injuries to the caregivers may contribute to a shortage of caregivers.

Mechanical lifts that support all the weight of a patient have been employed to reduce the rate of injury of caregivers when transferring the patient. Mechanical lifts are typically large with arms and sling-like members that are raised and lowered by hydraulic, electrical, or mechanical devices. The mechanical lifts may present a challenge for use by caregivers, for example, relatively long setup and operation times, relatively large size, relative difficulty in storage, and relatively high cost of manufacture, for example, because of consumption of material resources. Such challenges to use of mechanical lift technology may cause caregivers to instead perform manual transfers of the patient. Manual transfers may undesirably contribute to a relatively high rate of musculoskeletal injury among the caregiver population.

It may be a challenge to move patients that have lost some or all control of their body for various reasons, for example, a disability of the patient caused by injury, disease, or the natural aging process. It may be desirable to reduce operational costs, for example, in hospital and long-term care facilities, by promoting efficiency in performance of patient transfer. Manual transfers typically are the quickest form of patient transfer. Where the patient is of moderate weight, for example, up to approximately two hundred fifty (250) lbs or one hundred thirteen (113) kg, the caregiver may choose expediency of a manual transfer over use of the mechanical equipment. Even with two or three caregivers assisting with a manual transfer, the transfer time is typically less than using mechanical lift equipment. Speed of transfer is a reason caregivers may risk injury to save time.

The repeated practice of manual transfers may take a toll on the caregiver who may develop musculoskeletal injury. In a number of situations, mechanical lift equipment may be available. The mechanical lift equipment may be employed to support all of the patient weight and powered by a geared crank, an electric actuator, or an electric-hydraulic system. This equipment has been employed to support all of the patient weight during a patient transfer. Where a patient cannot take weight on their legs, a sling may be placed under the patient before transfer. Once the sling is in place, the mechanical lift may be connected to lift the patient off a start seating or lying location and move the patient. A challenge with the use of slings may involve difficulty in their placement under the patient and subsequent removal. The use of slings may undesirably lengthen the process, so the transfer may take twenty (20) or more minutes. Such a length of transfer time may discourage use of mechanical lift equipment because it may delay caregivers in their work. Consuming extra time for tasks may be undesirable in hospital and long-term care facilities. Additional challenges in use of slings comprise patients complaining about the feeling of being suspended, patients feeling degraded, the potential tearing of pressure ulcers while the sling slides around the patient during a lift, the chance of malfunction if the wrong sling loops are connected to the mechanical lift, lack of space available to store large size equipment, and consumption of material resources by the equipment creating high cost. As another example, the home environment may present additional constraints in storage and maneuvering space, presenting further challenge to the use of large size mechanical lift equipment.

An exemplary implementation is employable for transferring patients from a bed to a wheelchair and return while promoting a reduction in strain on the back of the caregiver. An exemplary implementation allows the caregiver to choose a relatively light-weight support structure, for example, in the range of twenty five to thirty (25 to 30) lbs or eleven to fourteen (11 to 14) kg. An exemplary implementation allows the caregiver to choose a relatively modest size support structure, for example, in the range of approximately eighteen (18) inches or forty-six (46) cm wide by twenty (20) inches or fifty-one (51) cm long. An exemplary implementation is employable in a relatively short amount of time, for example, in the range of one to two (1 to 2) minutes. An exemplary implementation allows a caregiver to perform patient transfer, for example, in hospital and long-term care facilities or the home contemporaneous with promotion of reduction in consumption of material resources, operating costs, and storage and maneuvering space.

Figure 10:
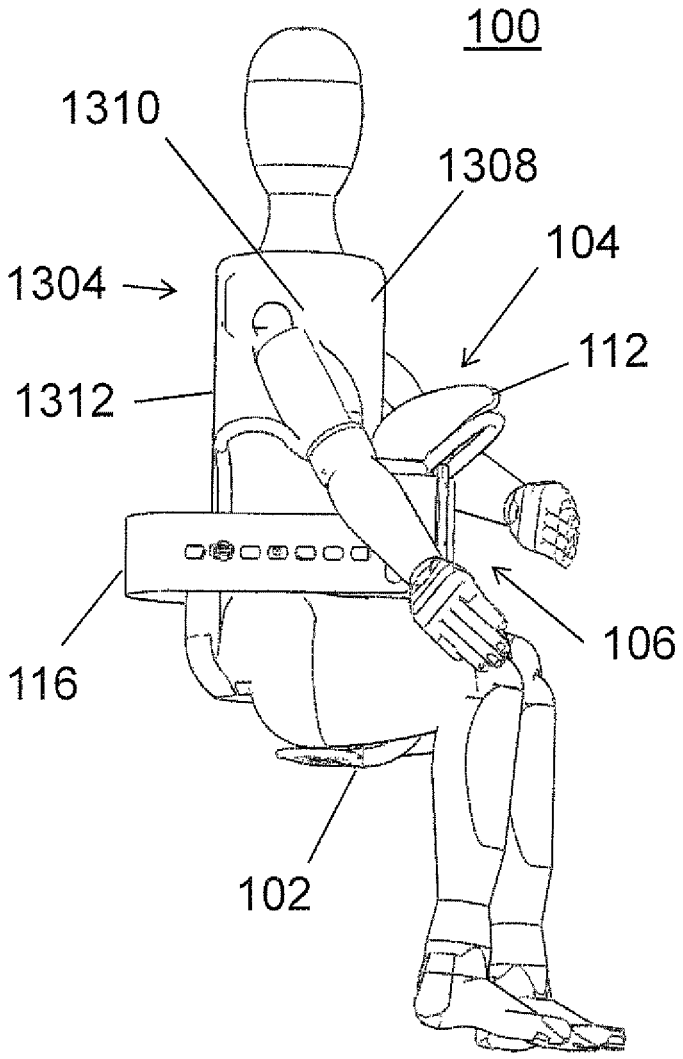
FIG. 10 is a side, perspective representation of an implementation of the apparatus of FIG. 1, illustrating the seat and the torso support fit onto the patient.
Figure 11:
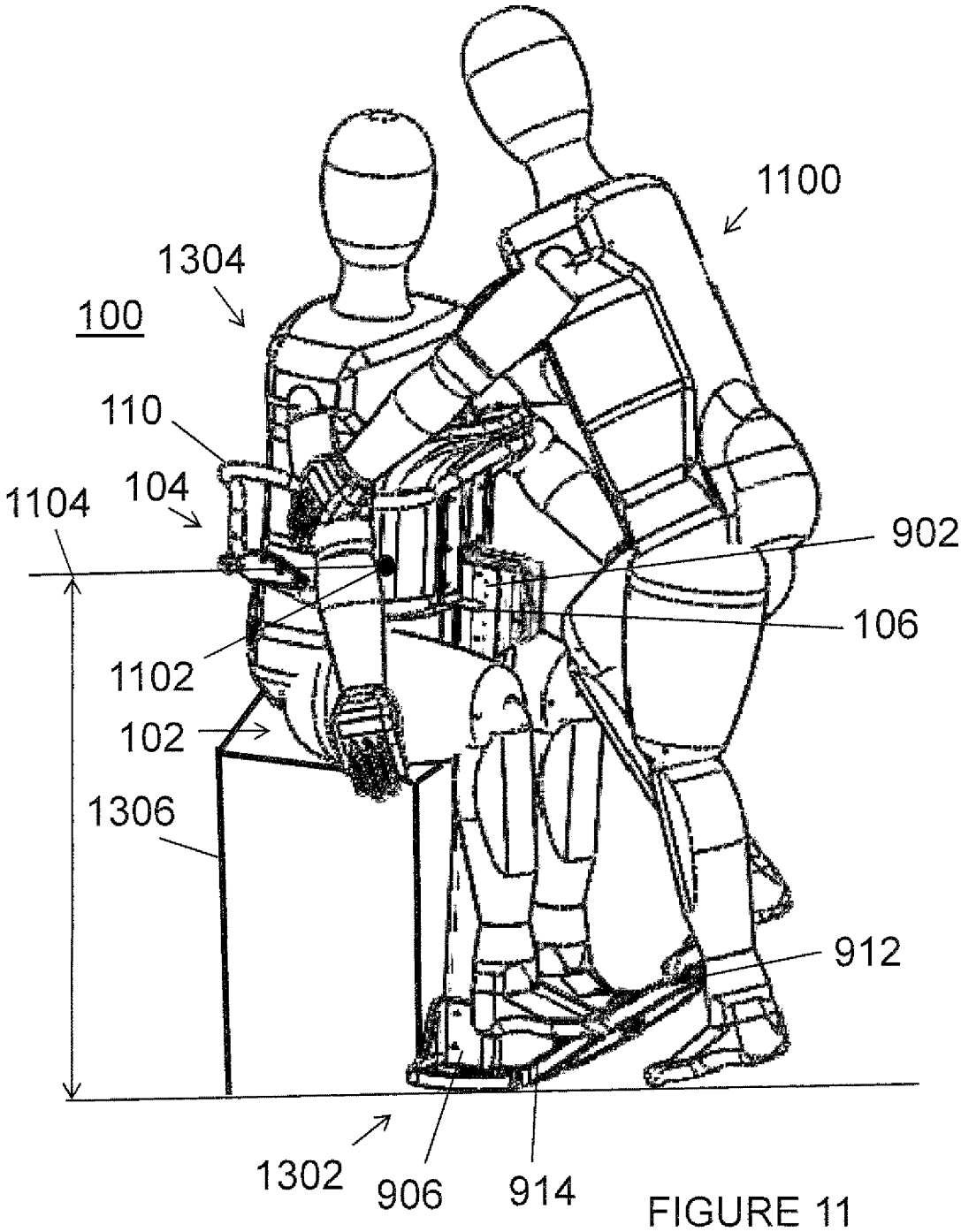
FIG. 11 is a side, perspective representation of an implementation of the apparatus of FIG. 9, illustrating the patient in a seated position and the seat and the torso support fit onto the patient at a start location, and the caregiver approaching the patient.

Turning to FIG. 1, an implementation of an apparatus 100 comprises a seat 102, a torso support 104, and a connector 106. The seat 102 and the torso support 104 in an example interface with a patient 1304 (FIG. 13) for control of an upper body 1310 (FIG. 13) of the patient 1304 for transfer by a caregiver 1100 (FIG. 11). Referring to FIGS. 10-13, the seat 102 in an example receives a portion of the thighs and/or buttocks of the patient 1304, for example, at one or more support areas under a natural sitting position of the patient 1304. The torso support 104 in an example abuts and/or partially surrounds a trunk of the patient 1304, for example, at front 1308 (FIG. 13) and sides of an intermediate region of the patient 1304 such as above a pelvis, over an abdomen, and to a thorax of the patient 1304. The caregiver 1100 in an example is a person who assists the patient 1304. The patient 1304 in an example is a disabled and/or infirm individual, for example, that has lost some or all control of the patient's body for various reasons, for example, a disability of the patient 1304 caused by injury, disease, or the natural aging process.

Referring to FIG. 1, the seat 102 in an example comprises a rigid core 108. The rigid core 108 serves to promote structural integrity for a shape of the seat 102 for support of the patient 1304 during transfer by the caregiver 1100. The rigid core 108 in an example comprises one or more of steel, aluminum, composite materials, nylon, glass filling, fibers, and/or epoxy matrix. The rigid core 108 in an example comprises cut and welded steel plate and tubing. The rigid core 108 in an example comprises lighter metals such as aluminum or molded composite materials such as nylon with glass filling or fibers with an epoxy matrix.

The torso support 104 is coupled with the seat 102. The torso support 104 comprises one or more handles 110 locatable proximate one or more sides of the patient 1304 and/or the front 1308 of the patient 1304 that serve to promote control of the upper body 1310 of the patient 1304 for transfer by the caregiver 1100. The handles 110 in an example are integral and/or unitary, for example, with a form of bent tubing of the torso support 104. In another example, the handles 110 are separate, for example, as a part fastened to the bent tubing of the torso support 104. The handles 110 may allow options for shape and material to be gripped by the caregiver 1100.

The torso support 104 in an example comprises steel and/or aluminum. The torso support 104 in an example comprises bent steel or aluminum tubing. The torso support 104 in an example comprises an outside diameter of half to one (0.5 to 1) inch or one to three (1 to 3) centimeters. The torso support 104 in an example comprises a soft padding 112 that serves to promote comfort of the patient 1304 during transfer. The soft padding 112 in an example comprises molded polyurethane foam. The soft padding 112 in an example comprises a density that can be varied to offer different levels of comfort for the patient 1304. The torso support 104 in an example comprises a back support latch 114 that allows a back support 116 to be removably connectable with the torso support 104. Referring to FIGS. 10-13, the torso support 104 in an example is locatable at the front 1308 of the patient 1304 and the back support 116 in an example is locatable behind the patient 1304 at a back 1312 of the patient 1304. The back support latch 114 in an example comprises an assembly of molded composite components. The back support latch 114 in an example comprises a securable latch.

The connector 106 is coupled with the seat 102 and/or the torso support 104. The connector 106 in an example comprises steel, for example, stainless steel and/or formed stainless steel. Stainless steel of the connector 106 in an example serves to resist corrosion. Stainless steel of the connector 106 in an example serves to reduce, avoid, and/or eliminate need for an additional coating and/or concerns about wear and/or scratching of such an additional coating over time. In a further example, one or more additional parts (not shown) such as plastic parts may be coupled, attached, and/or fastened to the connector 106 such as for covering of one or more edges that may be present in an example of the connector 106, as will be appreciated by those skilled in the art.

Figure 12:
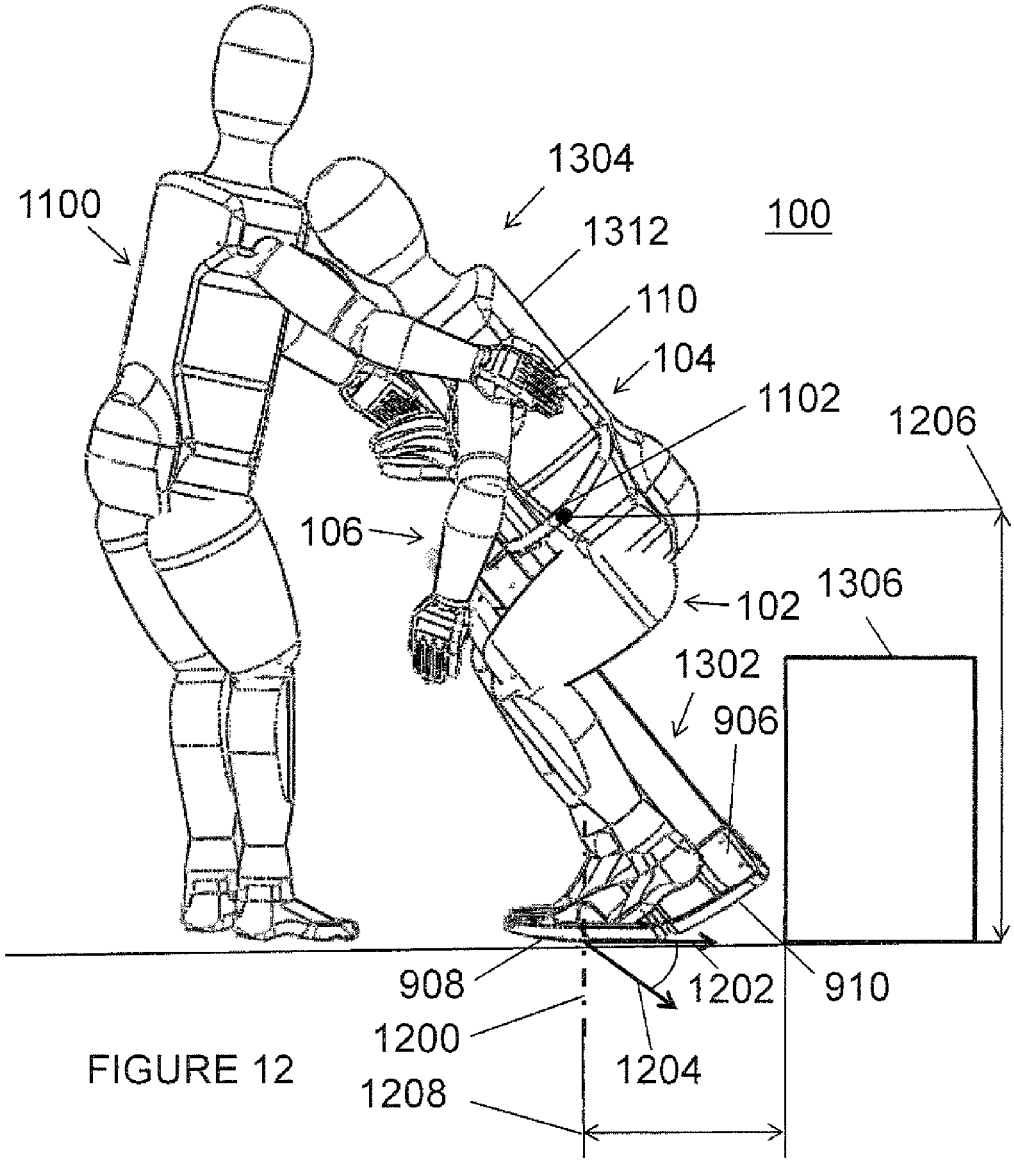
FIG. 12 is similar to FIG. 11 and illustrates the rockable base operated by the caregiver to transfer the patient from the start location to a target location, within a radial transfer distance.
Figure 13:
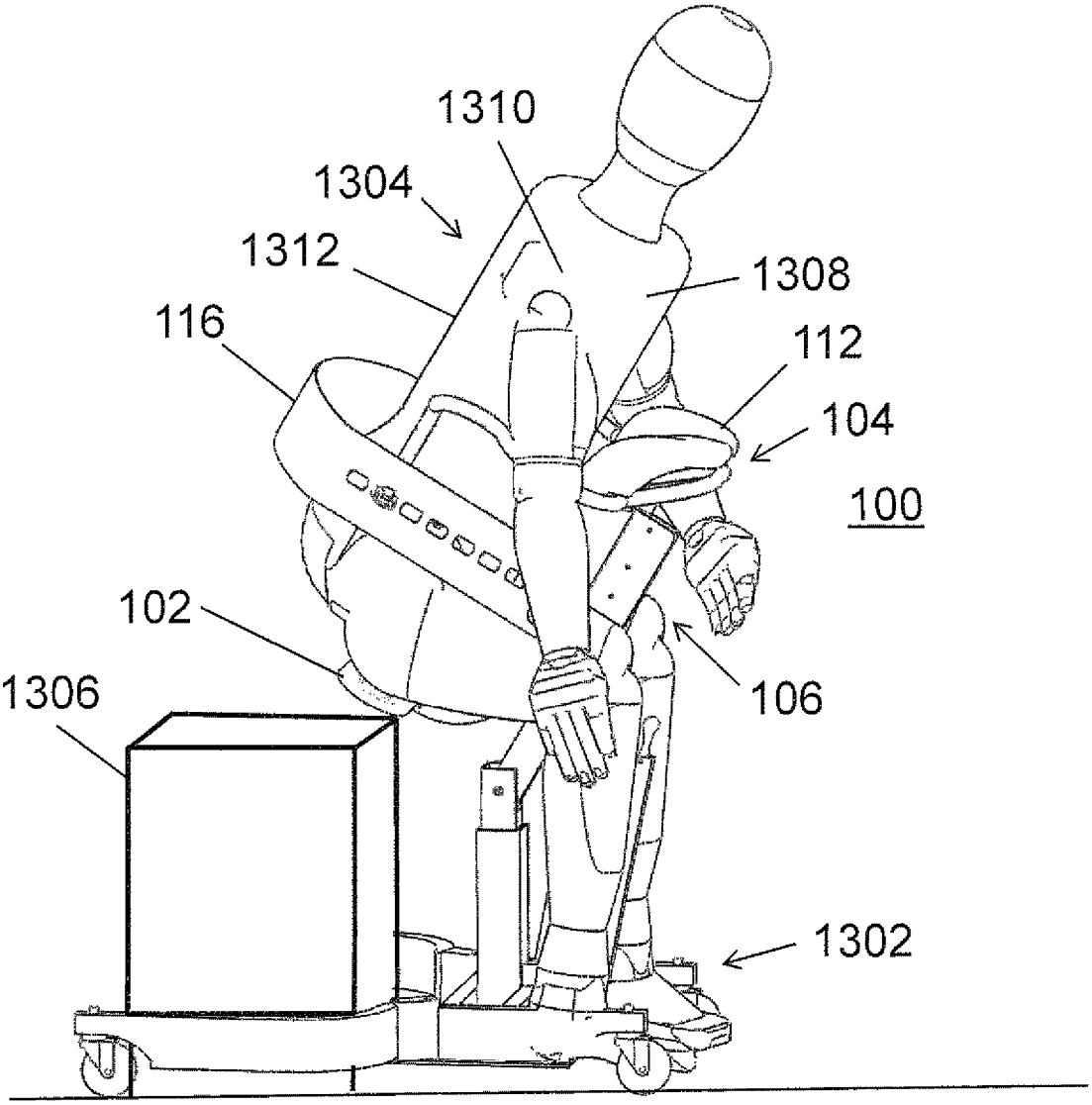
FIG. 13 is a representation of an implementation of the apparatus of FIG. 6 and illustrates the seat and the torso support fit onto the patient and the patient moved from a start location.

Referring to FIGS. 1 and 12 to 13, the connector 106 is removably connectable with an accessory 1302. The accessory 1302 in an example serves to at least in part support a weight of the patient 1304 relative to a load-bearing surface 1306. The accessory 1302 in an example comprises one or more of a carriage (FIG. 13), a knee pad (FIG. 7), a bedside attachment (FIG. 8), a rockable support (FIG. 9), and/or a tiltable car (FIG. 15), as described herein. The load-bearing surface 1306 in an example comprises one or more of a wheelchair, chair, seat, bed, commode, floor, ground, ledge, sill, edge, bench, horizontal surface, knee of the caregiver 1100, and/or couch. The load-bearing surface 1306 in an example may serve to directly support the accessory 1302, and in turn receive further support from another load-bearing surface 1306. For example, a knee of the caregiver 1100 may support a knee pad as the accessory 1302 (FIG. 7), and a floor as another load-bearing surface 1306 may in turn support the knee and other parts of the caregiver 1100, as will be appreciated by those skilled in the art.

A location of the patient 1304 on the seat 102, with a front 1308 of the patient 1304 faced toward the torso support 104 and the connector 106 coupled with the accessory 1302 allows control by a caregiver 1100 of an upper body 1310 of the patient 1304 for and during transfer by the caregiver 1100 from a start location such as on a first load-bearing surface 1306 to a target location such as on a second load-bearing surface 1306. Referring to FIGS. 11 and 12, the seat 102 and the torso support 104 in an example interface with the patient 1304 for control by the caregiver 1304 of an upper body 1310 of the patient 1304 for transfer.

Figure 2:
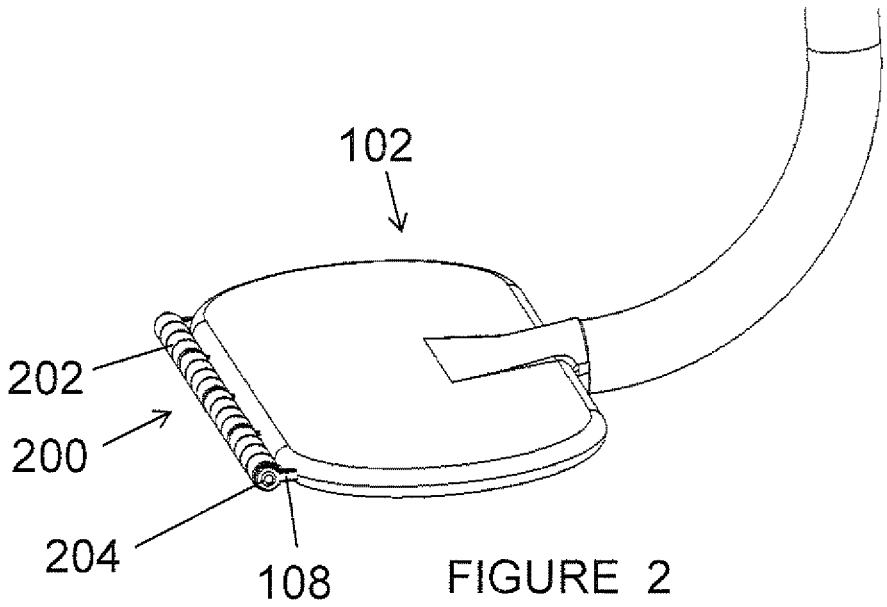
FIG. 2 is a top, side, perspective, enlarged, partial representation of an implementation of the seat and the connector of the apparatus of FIG. 1, illustrating the seat with a plurality of rollers.

Turning to FIG. 2, the seat 102 in an example comprises rollers 200, for example, supported, coupled, and/or connected with the rigid core 108. The rollers 200 in an example comprise bushings 202, for example, composite bushings. The rollers 200 in an example ride on a shaft 204, for example, a common shaft. Referring to FIG. 10, the rollers 200 in an example serve to promote insertability of the seat 102 under one or more legs of the patient 1304.

Figure 3:
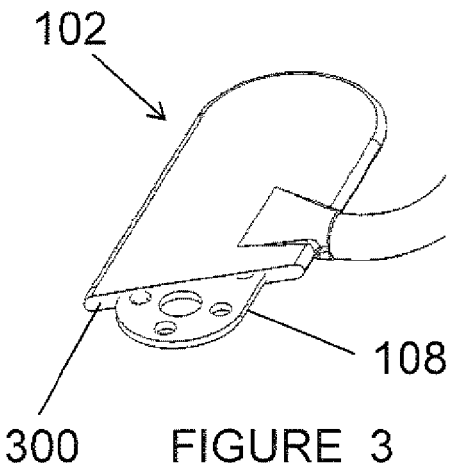
FIG. 3 is an end, side, perspective, enlarged, partial, cutaway representation of an implementation of the seat and the connector of the apparatus of FIG. 1, illustrating the seat with a relatively soft border around a peripheral portion of the seat.

Turning to FIG. 3, the seat 102 in an example comprises a border 300, for example, a relatively soft border, around a peripheral portion of the seat 102. The border 300 in an example is relatively compliant, for example, when one or more of legs of the patient 1304 (FIG. 10) are supported with the seat 102. The border 300 in an example comprises molded urethane material. The border 300 in an example comprises a hardness of twenty to forty (20 to 40) on the Shore A scale. The border 300 in an example serves to promote reduction and/or avoidance of risk of pinching the skin under one or more of the legs of the patient 1304. The border 300 in an example serves to promote reduction and/or avoidance of a painful experience for the patient 1304.

Figure 4:
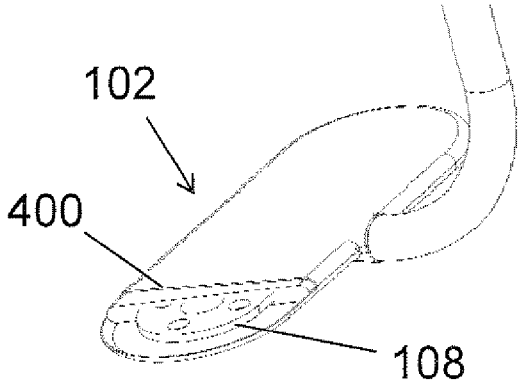
FIG. 4 is a top, rear, perspective, enlarged, partial, cutaway representation of an implementation of the seat and the connector of the apparatus of FIG. 1, illustrating the seat with a cover that is reusable or disposable.

Turning to FIG. 4, the seat in an example comprises a cover 400. The cover 400 in an example is reusable and/or disposable. The cover 400 in an example reduces friction for interface with the patient 1304 such as to engage the patient 1304 with the seat 102 for transfer by the caregiver 1100. The cover 400 in an example serves to promote reduction of cleaning time such as through protection of the seat 102. The cover 400 in an example comprises polyethylene material. The cover 400 in an example is relatively easily formable and bondable to itself such as with heat.

Figure 5:
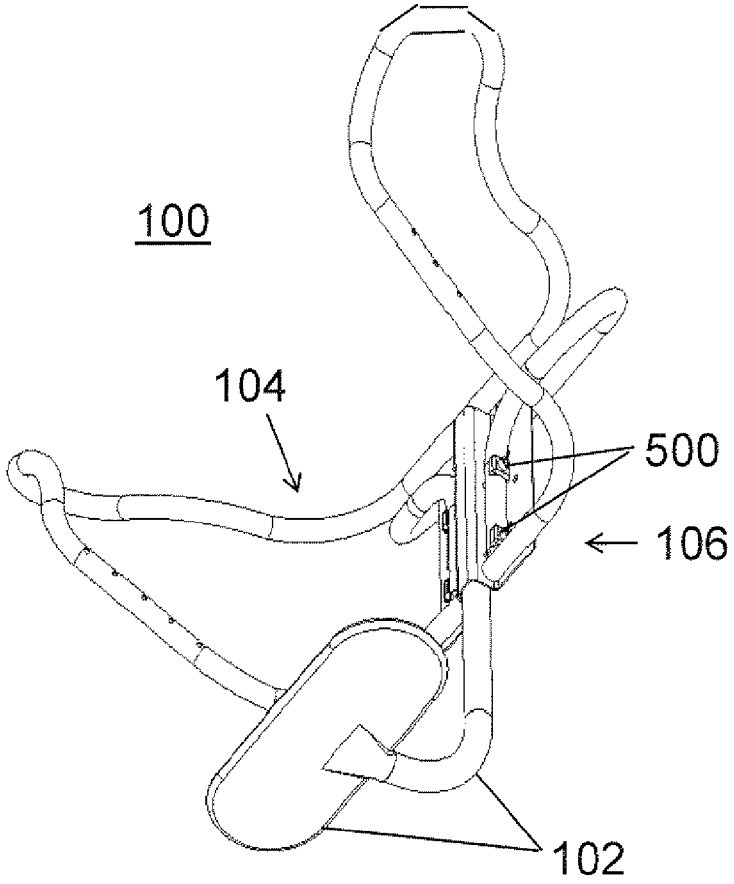
FIG. 5 is a bottom, side, perspective, representation of an implementation of the apparatus of FIG. 1, illustrating the seat and the torso support in a removable attachment relationship such as for replacement or interchangeability of the seat among a plurality of available seat configurations.

Turning to FIG. 5, the torso support 104 is removably connectable, for example, through employment of fasteners 500. The fasteners 500 in an example are insertable into aligned holes in the torso support 104 and the seat 102, as will be appreciated by those skilled in the art. The seat 102 and the torso support 104 in an example are in a removable attachment relationship such as for replacement or interchangeability of the seat 102 among a plurality of available seat configurations.

Figure 6:
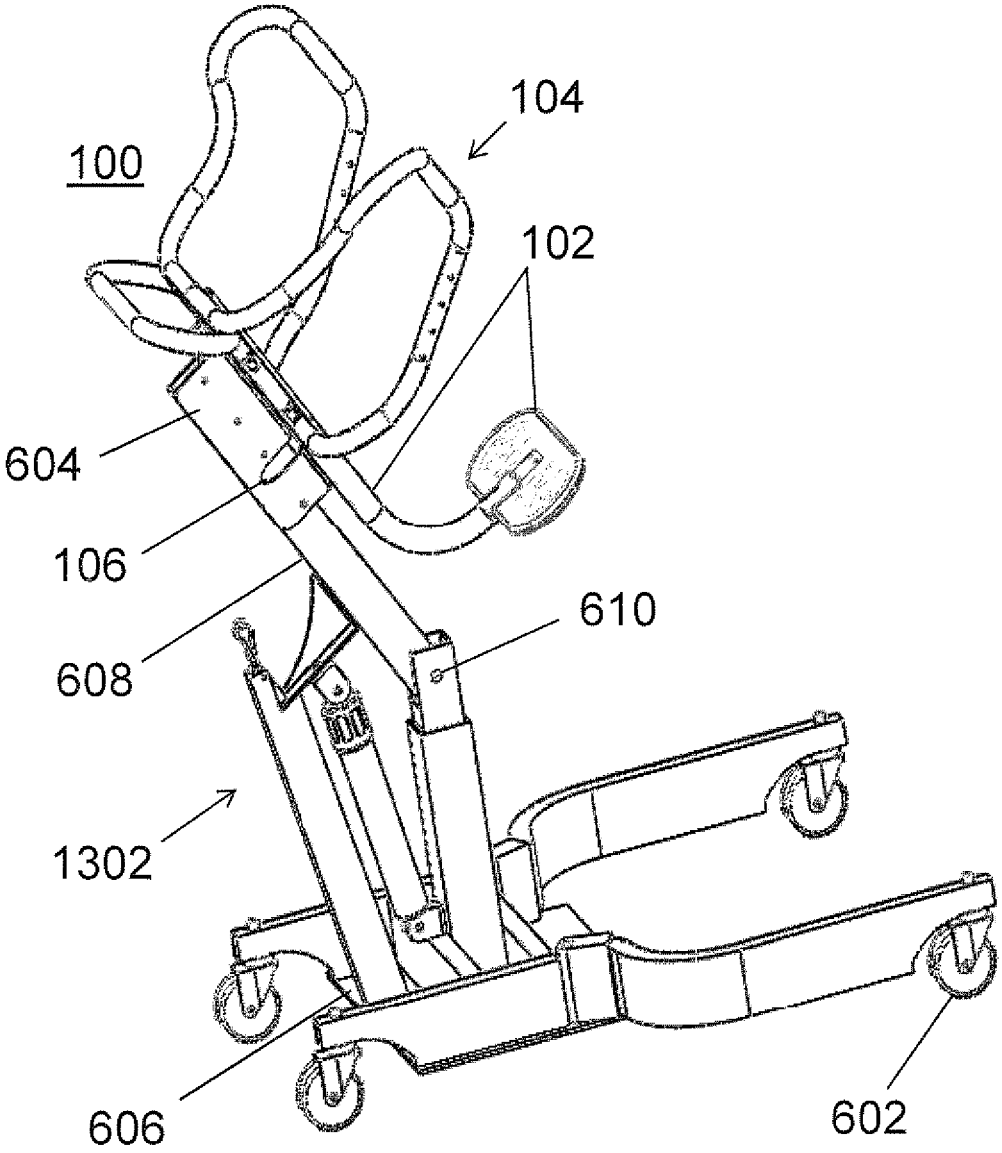
FIG. 6 is a rear, side, perspective representation of an implementation of the apparatus of FIG. 1, illustrating the apparatus with the seat, the torso support, the connector, and an accessory such as a carriage that is employable by the caregiver to support the weight of the patient and move the patient along the floor in any selected direction of a plurality of available directions.
Figure 16:
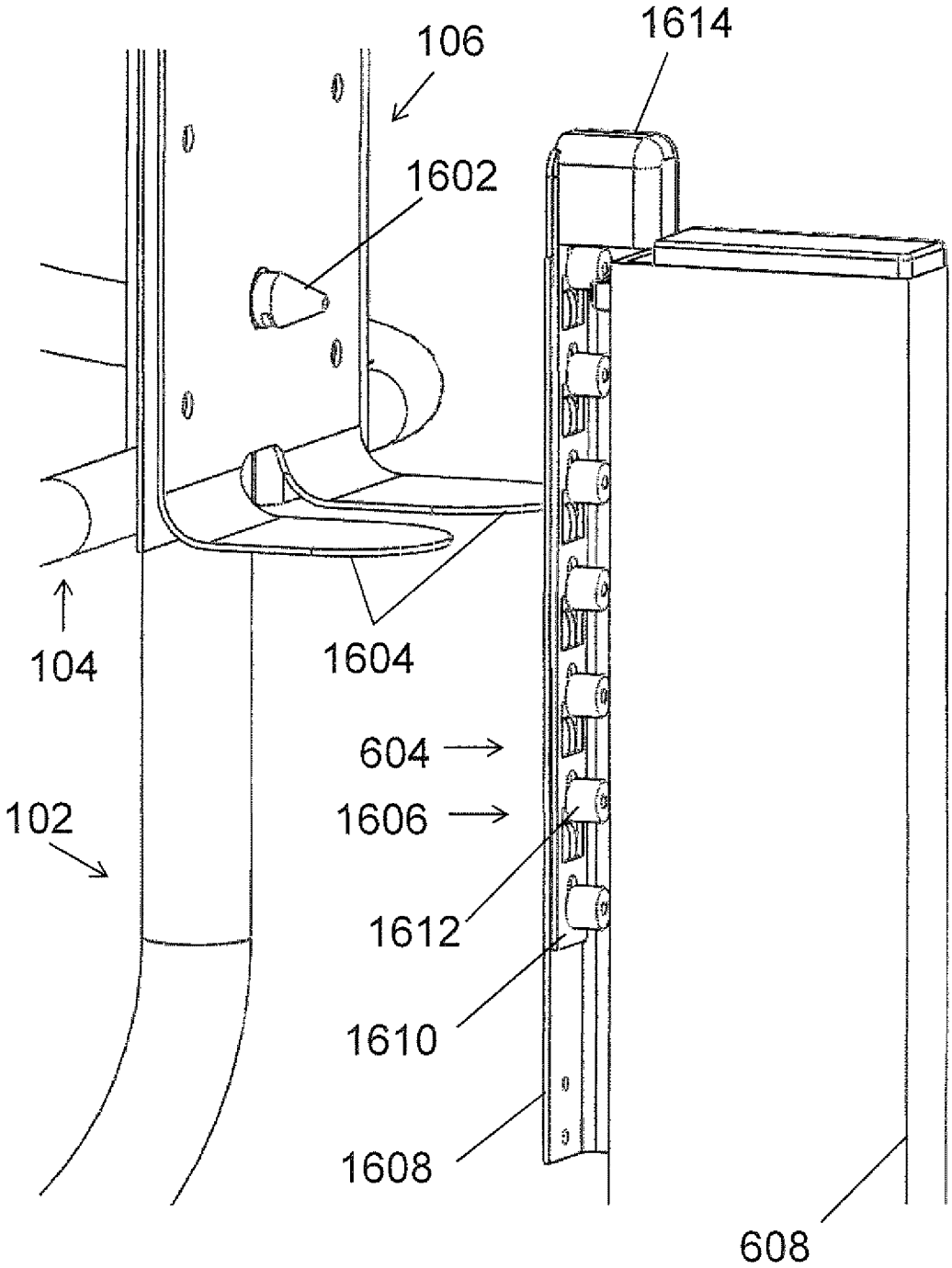
FIG. 16 is a rear, side, perspective, enlarged, partial, cutaway representation of an implementation of the connector of the apparatus of FIG. 6, illustrating a lock.

Turning to FIGS. 6, 13 and 16, the seat 102, the torso support 104, the connector 106 and an accessory 1302 such as a carriage are employable by the caregiver 1100 to support the weight of the patient 1304 along the floor as a load-bearing surface 1306. The accessory 1302 in an example comprises a plurality of wheels 602 that allows the caregiver 1100 (FIG. 11) to move the patient 1304 (FIG. 10) in any selected and/or desirable direction of a plurality of available directions along a floor as the load-bearing surface 1306.

The connector 106 in an example comprises a steel pin 1602 and support arms 1604, for example, that straddle a connector 604 and provide a rigid connection. The connector 604 in an example comprises a connector housing 1608. The connector housing 1608 in an example comprises formed stainless steel. Stainless steel of the connector housing 1608 in an example serves to reduce, avoid, and/or eliminate need for an additional coating and/or concerns about wear and/or scratching of such an additional coating over time.

The connector housing 1608 in an example comprises a plurality of vertically spaced holes 1606, for example, that mate with and/or receive the steel pin 1602 of the connector 106. The vertically spaced holes 1606 in an example comprise a lock 1610, for example, to retain the steel pin 1602. The lock 1610 in an example comprises guide bushings 1612 and a lock button 1614. The guide bushings 1612 in an example serve to constrain movement. The lock button 1614 in an example serves as an interface for the caregiver 1100 to selectively cause decoupling of the connectors 106 and 604.

The connector 106 in an example comprises a first connector and the connector 604 in an example comprises a second connector. The connector 604 in an example mates at variable height with the connector 106. A tiltable support 608 in an example comprises an aluminum or steel tube. The tiltable support 608 in an example is employable to tilt at a pivot point 610 and move the patient 1304 off an original seating position at a start location such as on a load-bearing surface 1306 (FIG. 11), so the patient 1304 becomes fully and/or substantially supported by the carriage as the accessory 1302. The carriage as the accessory 1302 in an example comprises a welded aluminum or steel tube structure. The carriage as the accessory 1302 in an example fits around a chair or under a seating location as a load-bearing surface 1306 that has a relatively low clearance, for example, five (5) inches or thirteen (13) centimeters. A platform 606 serves to support one or more feet of the patient 1304 and prevent and/or avoid dragging of the patient's feet.

Figure 7:
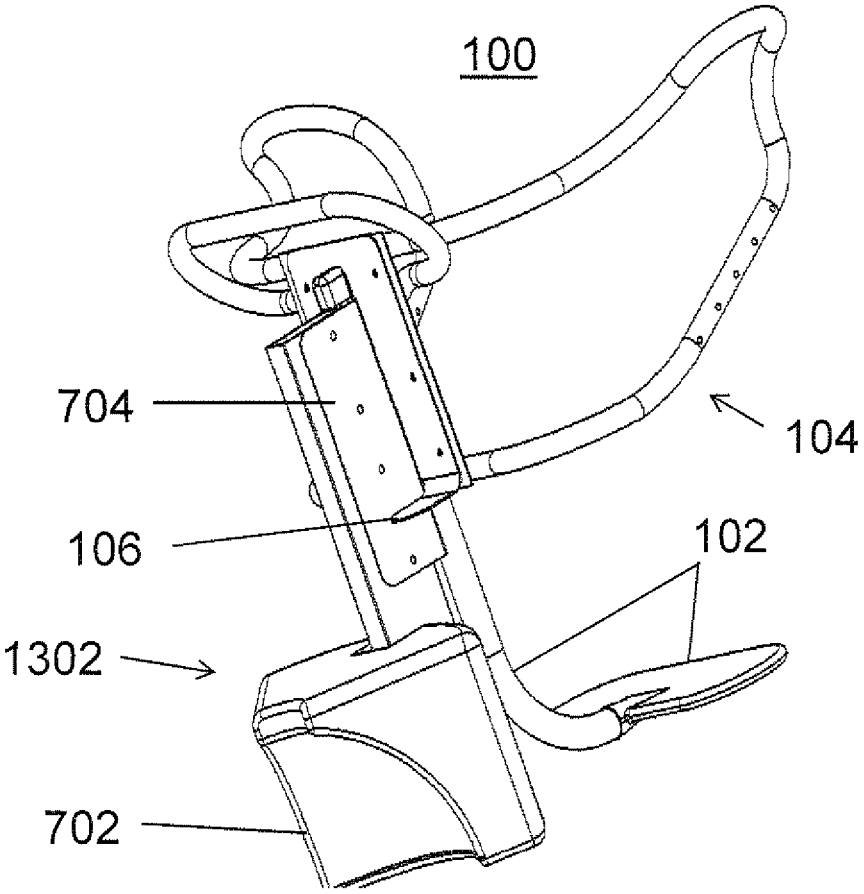
FIG. 7 is a rear, side perspective representation of an implementation of the apparatus of FIG. 1, illustrating the apparatus with the seat, the torso support, the connector, and an accessory such as with a knee pad that is shaped to engage a knee of the caregiver and allow the caregiver to use the knee of the caregiver to assist with transfer of the patient.

Turning to FIG. 7, an accessory 1302 such as a knee pad is employable by the caregiver 1100. The knee pad as the accessory 1302 in an example allows the caregiver 1100 (FIG. 11) to use the caregiver's knee to assist with transfer of the patient 1304. The knee pad as the accessory 1302 in an example comprises a padding 702. The padding 702 in an example fits over the knee of the caregiver 1100. The padding 702 in an example comprises molded foam material. The padding 702 in an example promotes comfort of the caregiver 1100. A connector 704 in an example mates at variable height with the connector 106. The connector 106 in an example comprises a first connector and the connector 704 in an example comprises a second connector.

Figure 8:
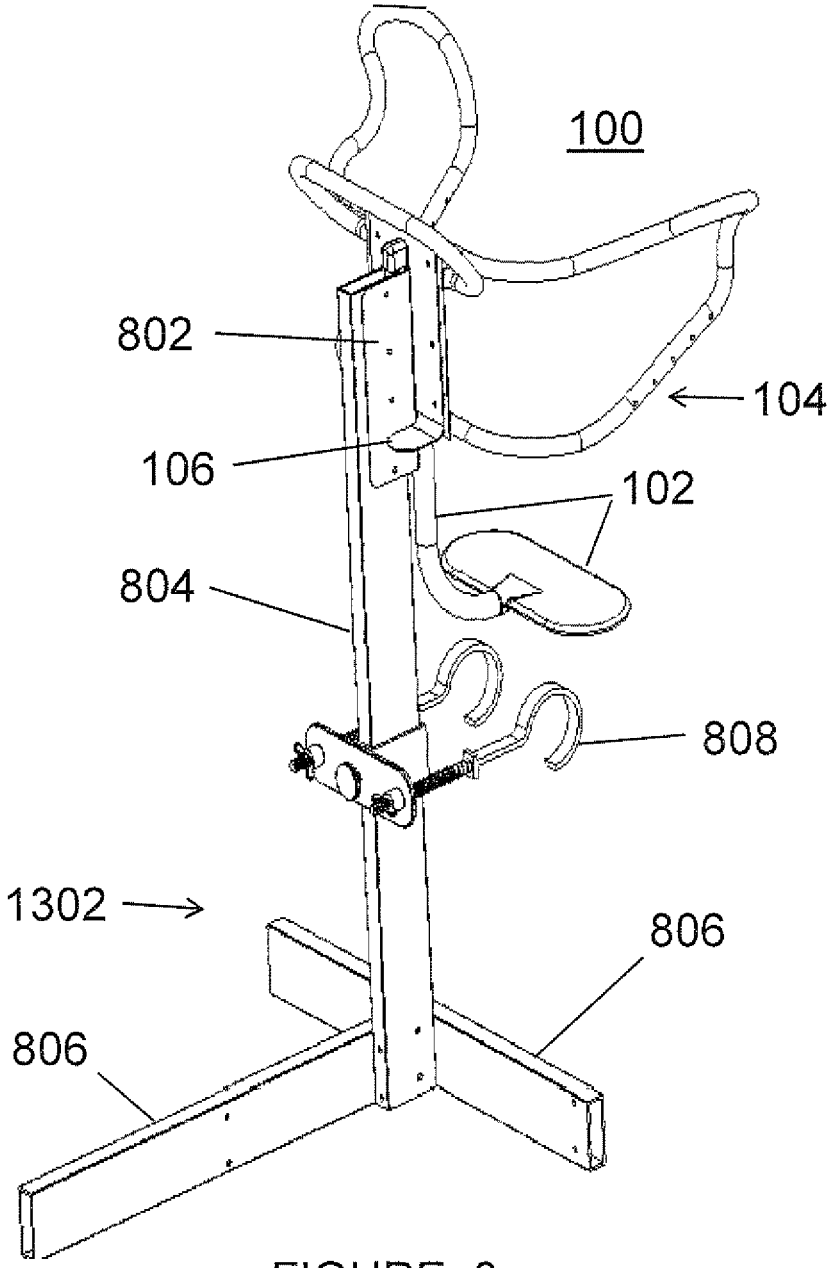
FIG. 8 is a rear, top, perspective representation of an implementation of the apparatus of FIG. 1, illustrating the apparatus with the seat, the torso support, the connector, and an accessory such as with a bedside attachment to allow the patient to remain in a seated position at the edge of a bed.

Turning to FIG. 8, an accessory 1302 such as a bedside attachment is employable by the caregiver 1100 to allow the patient 1304 (FIG. 11) to remain in a seated position at the edge of a bed as a load-bearing surface 1306. The bedside attachment as the accessory 1302 in an example comprises a connector 802 that mates at variable height with the connector 106. The connector 106 in an example comprises a first connector and the connector 802 in an example comprises a second connector. The bedside attachment as the accessory 1302 in an example comprises an intermediate support 804 that extends to a base 806 set on a floor, for example, to maintain the patient 1304 in a seated position. The intermediate support 804 in an example comprises an aluminum or steel tube. The bedside attachment as the accessory 1302 in an example comprises a fastener 808. The fastener 808 in an example comprises bent steel hooks and/or nylon straps. The fastener 808 in an example connects with a typical bed frame such as for additional security to maintain the patient 1304 in a vertical seated position. Maintaining the patient 1304 in a vertical seated position in an example serves to promote a reduction of risk of the patient 1304 developing and/or acquiring bed sores.

Figure 9:
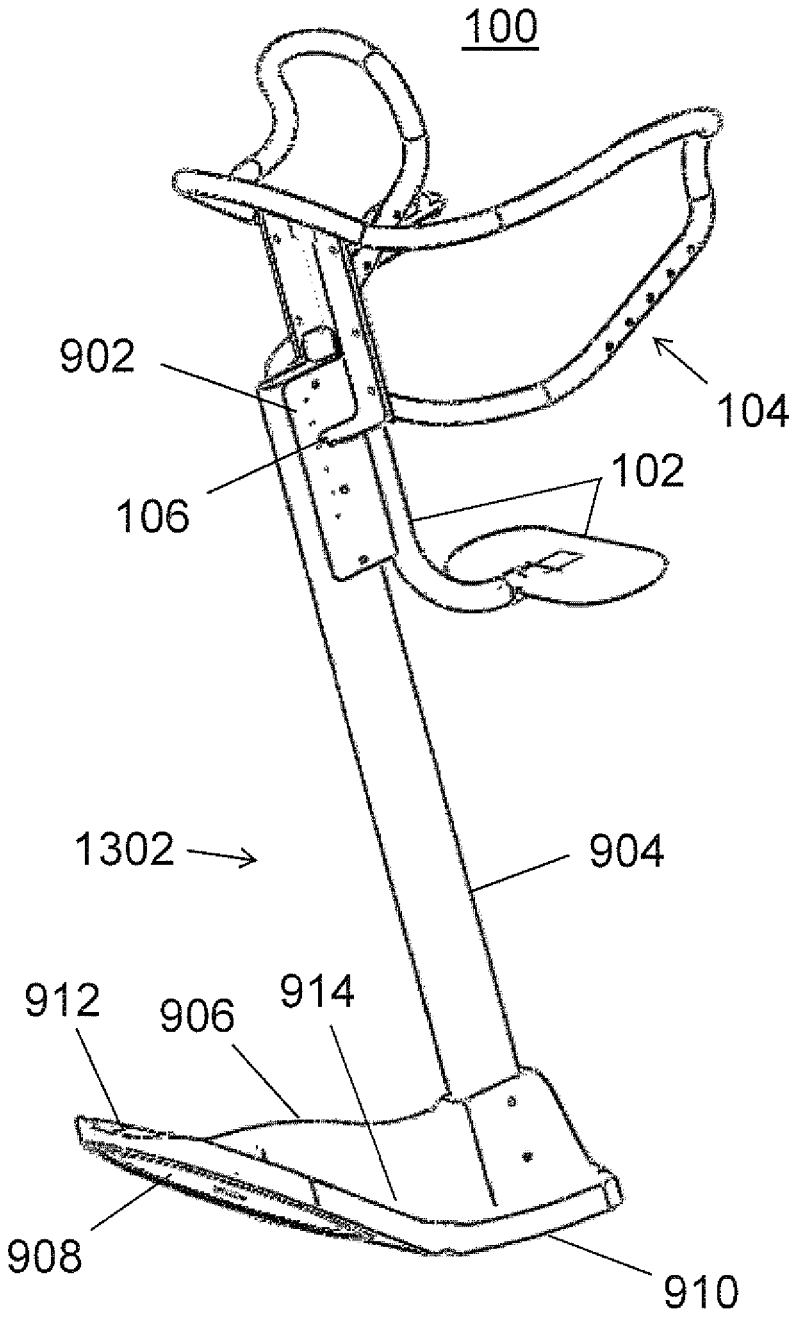
FIG. 9 is a rear, side, perspective representation of an implementation of the apparatus of FIG. 1, illustrating the apparatus with the seat, the torso support, the connector, and an accessory such as with a rockable support that is operable by the caregiver to support the weight of the patient during transfer.

Turning to FIG. 9, an accessory 1302 such as a rockable support in an example comprises a connector 902 that mates at variable height with the connector 106. The connector 106 in an example comprises a first connector and the connector 902 in an example comprises a second connector. An intermediate support 904 in an example extends from the connector 902 to a rockable base 906. The intermediate support 904 in an example comprises an aluminum tube or fiber with epoxy matrix. The rockable base 906 in an example comprises cast aluminum or molded composite materials, for example, nylon with glass filling. The rockable base 906 in an example is connected to the intermediate support 904 and serves to support at least in part a weight of the patient 1304 (FIG. 10) on the floor as a load-bearing surface 1306.

The rockable base 906 in an example comprises a curved surface 910 that rocks on the floor as the load-bearing surface 1306 during transfer of the patient 1304. The curved surface 910 in an example leads to a rotary disk end 908 of the rockable base 906. The rotary disk end 908 in an example comprises a low friction bearing for low effort rotation during transfer. A foot pedal end 912 of rockable base 906 in an example allows the caregiver 1100 (FIG. 11) to step onto the rockable base 906 to use the caregiver's own bodyweight to assist and oppose a weight of the patient 1304. The rockable base 906 in an example comprises an upper curved surface 914 that allows the feet of the patient 1304 to rest on the rockable base 906 such as to prevent and/or avoid dragging of the patient's feet on the floor during transfer.

Turning to FIG. 10, the seat 102, the torso support 104, and the connector 106 are fit onto the patient 1304 for the caregiver 1100 to control the upper body 1310 of the patient 1304. The seat 102 fits between the legs of the patient 1304 and partially supports a weight of the patient 1304 under the legs during transfer by the caregiver 1100. The soft padding 112 connected to torso support 104 in an example contacts the front 1308 of the patient 1304 and partially supports a weight of the patient 1304 during transfer. The back support 116 contacts the back 1312 of the patient 1304. The seat 102 and the torso support in an example are fit with the patient 1304 while the patient 1304 is in a lying position or a sitting position. The seat 102 and the torso support in an example provides contact and support to the patient 1304 with employment of any selected accessory 1302 of one or more available accessories 1302.

Turning to FIG. 11, the seat 102 and the torso support in an example are fit onto the patient 1304 at a start location such as on a load-bearing surface 1306 and the caregiver 1100 approaching the patient 1304. A center of mass 1102 of the patient 1304 in an example comprises an initial center of mass height 1104 on load-bearing surface 1306. The connector 902 in an example mates with the connector 106. The feet of the patient 1304 in an example are set on upper curved surface 914 of the rockable base 906.

To begin transfer, the caregiver 1100 in an example grasps and pulls one or more handles 110 of the torso support 104. In a further example to begin transfer, the caregiver 1100 grasps and pulls one or more handles 110 of the torso support 104 and, for example, optionally, steps on foot pedal end 912 of rockable base 906 simultaneously, concurrently, and/or contemporaneously. The caregiver 1100 in an example is allowed to maintain a substantially straight posture during transfer of the patient 1304, for example, reducing stress on the lower lumbar spinal region of the caregiver 1100.

Turning to FIG. 12, the patient 1304 in an example is positioned on the rotary disk end 908 of the rockable base 906. The patient 1304 in an example is transferred off the load-bearing surface 1306 by rocking on the curved surface 910 of the rockable base 906. The center of mass 1102 of the patient 1304 in an example is at a new center of mass height 1206. The height difference between the center of mass height 1104 (FIG. 11) and the new center of mass height 1206 in an example is kept substantially the same, for example, to promote reduction of effort the caregiver 1100 needs to exert during transfer of the patient 1304.

The rotary disk end 908 of the rockable base 906 in an example allows the caregiver 1100 to rotate the patient 1304 about a rotation axis 1200, for example, to change the patient orientation from a start location direction 1202 to a target location direction 1204. The target location in an example is located within a radial transfer distance 1208. The radial transfer distance 1208 in an example is between ten and eighteen (10 to 18) inches or twenty five to forty five (25 to 45) centimeters. The radial transfer distance 1208 in an example serves to allow and/or promote better centering of the patient 1304 with the target location. Depositing the patient 1304 onto the target location in an example is accomplished by the caregiver 1100 through employment of the reverse operation of rocking on the curved surface 910 of the rockable base 906 in the target location direction 1204.

Turning to FIG. 13, the seat 102 and the torso support 104 are fit onto the patient 1304 by the caregiver 1100. The patient 1304 in an example is moved by the caregiver 1100 from a start location such as on a load-bearing surface 1306. The patient 1304 in an example occupies a transport position for the patient 1304 to be transferred along the floor, for example, as an indirect load-bearing surface through the carriage as the accessory 1302. The feet of the patient 1304 in an example are set on the platform 606 (FIG. 6) by the caregiver 1100. The patient 1304 in an example is transferred off the load-bearing surface 1306 by tilting about the pivot point 610 (FIG. 6). The carriage as the accessory 1302 in an example serves to maintain the patient 1304 in a transport position.

Figure 14:
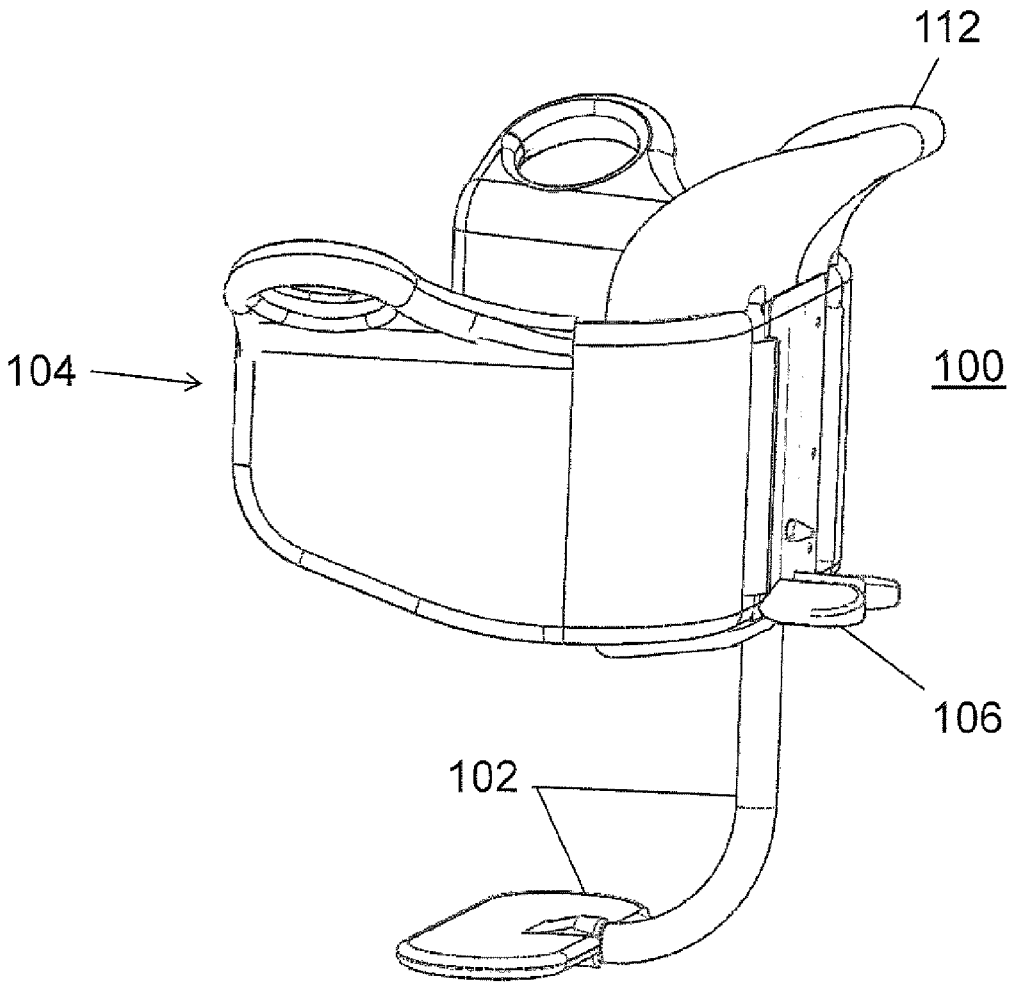
FIG. 14 is representation of an implementation of the apparatus of FIG. 1, illustrating another implementation of the torso support.

Turning to FIG. 14, the torso support 104 in an example comprises structural foam material. The torso support 104 in an example is manufactured through employment of a structural foam molding process. The torso support 104 in an example with structural foam material can be joined to the seat 102 through employment of an insert molding process. The soft padding 112 in an example comprises a chest pad. The soft padding 112 in an example comprises a soft foam material, for example, that can be joined to the torso support 104 through employment of an insert molding process. The torso support 104 in an example comprises a more and/or relatively continuous outside surface, for example, that promotes easier sterilization, reduction in manufacturing cost, and/or reduction in potential weight.

Figure 15:
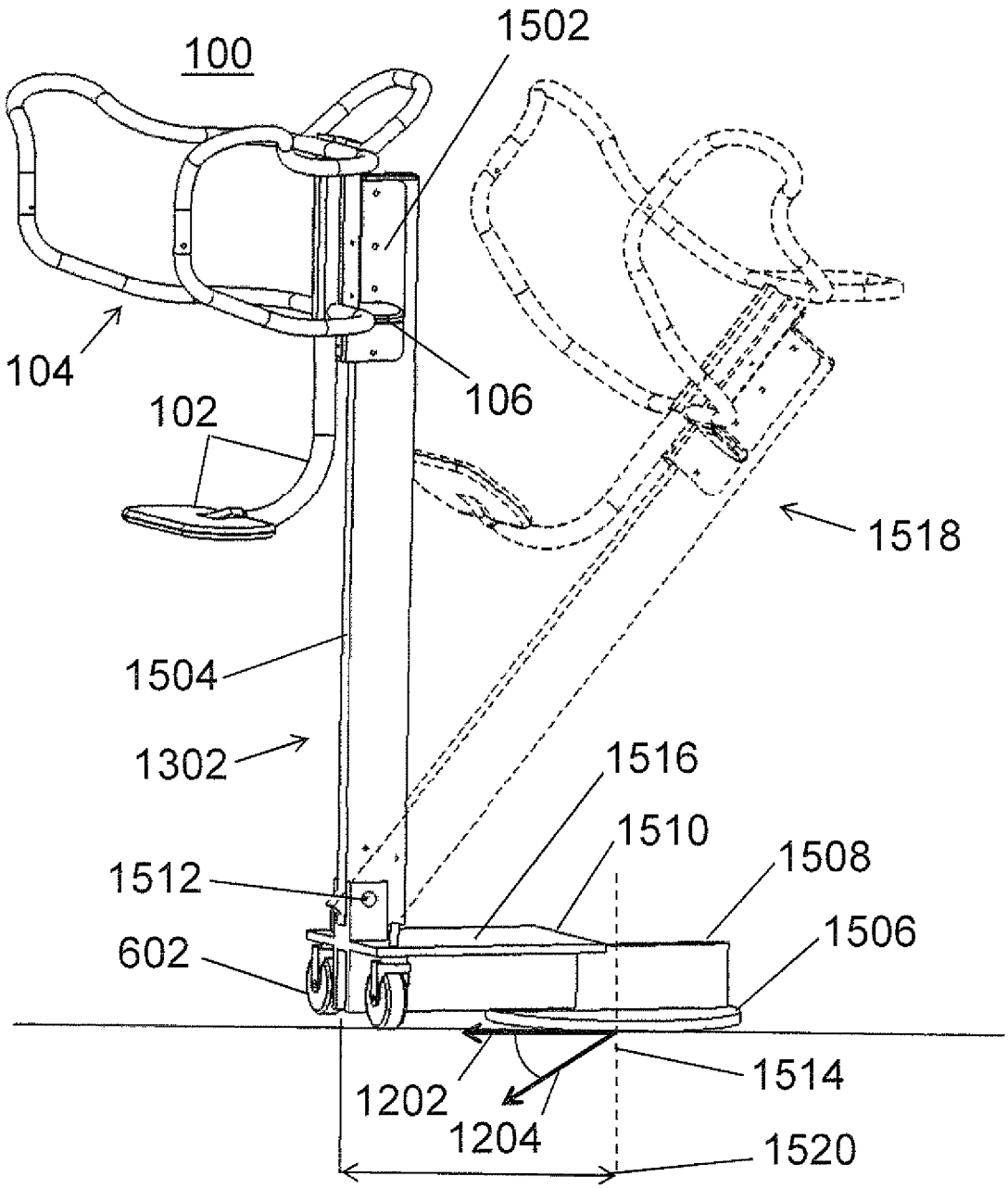
FIG. 15 is a front, side, perspective representation of an implementation of the apparatus of FIG. 1, illustrating the apparatus with the seat, the torso support, the connector, and an accessory with a tiltable car that as operated by the caregiver serves to support weight of the patient during transfer within a radial transfer distance.

Turning to FIG. 15, an accessory 1302 such as a tiltable car comprises a connector 1502 that mates at variable height with the connector 106. The connector 106 in an example comprises a first connector and the connector 1502 in an example comprises a second connector. A tiltable support 1504 in an example extends from the connector 1502 to a car 1510 at a pivot point 1512.

The car 1510 in an example comprises a platform 1516 to support one or more feet of the patient 1304 (FIG. 10) such as to prevent and/or avoid dragging of the patient's feet on the floor. The tiltable support 1504 in an example tilts at the pivot point 1512 to transfer the patient 1304 off a load bearing surface 1306 (FIG. 11), for example, so the weight of the patient 1304 is at least partially supported by the car 1510 as the accessory 1302 in a transport position 1518 for transfer of the patient 1304 by the caregiver 1100. The car 1510 in an example rides on a rail 1508. The rail 1508 in an example serves to constrain movement of the car 1510 and transfer the weight of the patient 1304 onto a rotary disk 1506. The car

1510 in an example comprises a plurality of wheels 602 that partially support the weight of the patient 1304.

The car 1510 in an example is extendable to the load-bearing surface 1306. When the patient 1304 is in the transport position 1518, the caregiver 1100 (FIG. 11) in an example can move the car 1510 along the rail 1508 and over a rotary disk 1506 to support the weight of the patient 1304. The rotary disk 1.506 in an example comprises a low friction bearing that allows the caregiver 1100 to rotate the patient 1304, for example, with a relatively low effort about a rotation axis 1514 such as to change orientation of the patient 1304 from a start location direction 1202 to a target location direction 1204.

The target location in an example is within a radial transfer distance 1520 of the car 1510. The radial transfer distance 1520 in an example is in the range of approximately ten to eighteen (10 to 18) inches or twenty five to forty five (25 to 45) centimeters. The radial transfer distance 1520 in an example serves to allow and/or promote better centering of the patient 1304 with the target location. Depositing the patient 1304 onto the target location in an example is accomplished by the caregiver 1100 through employment of the reverse operation of tilting the patient about the pivot point 1512 in the target location direction 1204.

Figure 17:
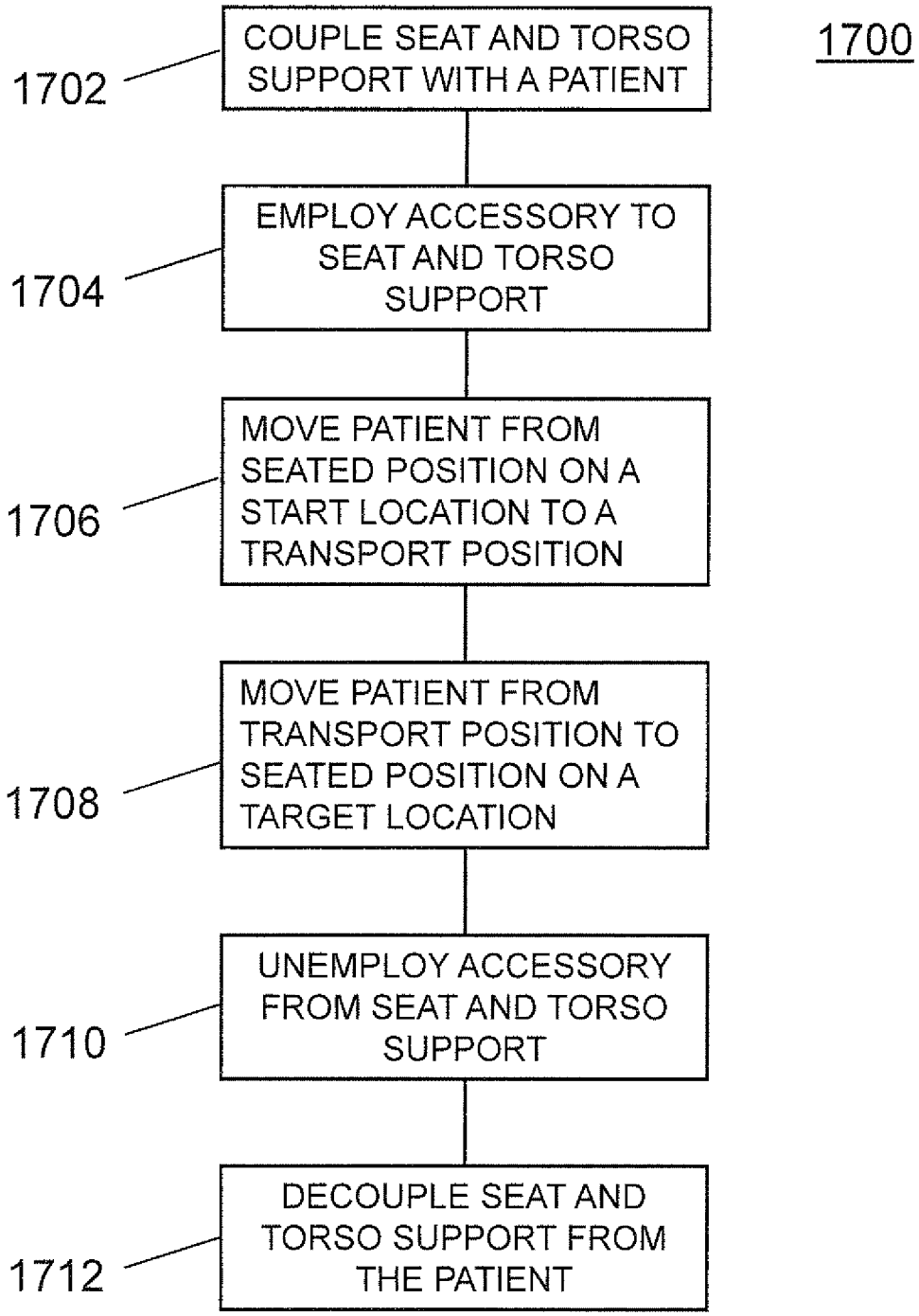
FIG. 17 is a representation of an exemplary flow for operation of an implementation of the apparatus of FIG. 1.

An illustrative description of an exemplary operation of an implementation of the apparatus 100 is presented, for explanatory purposes. Turning to FIG. 17, in an exemplary flow 1700 at STEP 1702, a caregiver 1100 couples a seat 102 and torso support 104 with a patient 1304 while the patient 1304 is lying down or sitting up. The seat 102 and torso support 104 support the patient 1304 around the torso and under the leg. The torso support 104 provides handles 110 proximate to the patient 1304. At STEP 1704, caregiver 1100 employs an accessory 1302 with seat 102 and torso support 104. Accessory 1302 is employed with seat 102 and torso support 104 substantially supporting a weight of the patient 1304. Accessory 1302 is employed with seat 102 and torso support 104 allowing control by the caregiver 1100 of an upper body 1310 of the patient 1304.

At STEP 1706, caregiver 1100 moves the patient 1304 from a seated position on a start location such as on a load-bearing surface 1306 to a transport position. Caregiver 1100 uses handles 110 to manually change direction of the patient 1304 in the transport position. At STEP 1708, caregiver 1100 moves the patient 1304 from the transport position to a seated position on a target location. The caregiver 1100 uses handles 110 to manually move patient 1304 from the transport position to a seated position on the target location. At STEP 1710, caregiver 1100 unemploys the accessory 1302 from seat 102 and torso support 104. The unemployment of the accessory 1302 is accomplished by the caregiver 1100 pushing the lock button 1614. At STEP 1712, caregiver 1100 decouples seat 102 and torso support 104 from the patient 1304.

An implementation of the apparatus 100 comprises a plurality of components such as one or more of mechanical components and/or hardware components. A number of such components can be combined or divided in an implementation of the apparatus 100. In one or more exemplary implementations, one or more features described herein in connection with one or more components and/or one or more parts thereof are applicable and/or extendible analogously to one or more other instances of the particular component and/or other components in the apparatus 100. In one or more exemplary implementations, one or more features described herein in connection with one or more components and/or one or more parts thereof may be omitted from or modified in one or more other instances of the particular component and/or other components in the apparatus 100. An implementation of the apparatus 100 comprises any (e.g., horizontal, oblique, angled, or vertical) orientation, with the description and figures herein illustrating an exemplary orientation of an exemplary implementation of the apparatus 100, for explanatory purposes.

The steps or operations described herein are examples. There may be variations to these steps or operations without departing from the spirit of the invention. For example, the steps may be performed in a differing order, or steps may be added, deleted, or modified.

Although exemplary implementation of the invention has been depicted and described in detail herein, it will be apparent to those skilled in the relevant art that various modifications, additions, substitutions, and the like can be made without departing from the spirit of the invention and these are therefore considered to be within the scope of the invention as defined in the following claims.

What is claimed is:

1. An apparatus, comprising:

a seat that comprises a rigid core that transitions into a rigid support beam from an intermediate location along a transverse dimension of the seat; and a torso support coupled with the rigid support beam of the seat;

a connector that is coupled with the seat and/or the torso support, wherein the connector is removably connectable with an accessory that serves to at least in part support a weight of a patient relative to a load-bearing surface;

wherein a location of the patient on seat with:

the seat placed under at least one thigh and/or buttock of the patient from the front of the patient;

the patient straddling the rigid support beam with at least one thigh of the patient;

a front of the patient faced toward the torso support and the connector coupled with the accessory; allows control by a caregiver of an upper body of the patient for and during transfer of the patient by the caregiver from a start location to a target location;

wherein the rigid core and the rigid support beam promote avoidance of flexing of the seat under load of the patient on the apparatus;

wherein a tilting motion of the apparatus causes a direct lifting of buttocks of the patient.

2. The apparatus of claim 1, wherein the torso support comprises one or more handles locatable proximate one or more sides of the patient and/or the front of the patient that serve to promote control of the upper body of the patient for transfer of the patient by the caregiver.

3. The apparatus of claim 1, further comprising:

a back support that is removably connectable with the torso support, wherein the torso support is locatable in front of the patient, wherein the back support is locatable behind the patient;

wherein the torso support and the back support are coordinately employable for transfer of the patient by the caregiver.

4. The apparatus of claim 1, wherein the torso support comprises a relatively soft padding that serves to promote comfort of the patient during transfer of the patient by the caregiver.

5. The apparatus of claim 1, wherein the seat comprises a relatively soft border around a peripheral portion of the seat that serves to promote comfort of the patient during transfer of the patient by the caregiver.

6. The apparatus of claim 5, wherein the relatively soft border comprises a low profile and one or more elastomeric properties for compliance to a leg of the patient that distributes stress of the weight of the patient on the seat.

7. The apparatus of claim 1, wherein the seat comprises one or more rollers that are employable for insertion of the seat under one or more legs of the patient to promote ease of transfer of the patient by the caregiver.

8. The apparatus of claim 1, wherein the seat comprises a seat cover that is reusable or disposable.

9. The apparatus of claim 1, wherein the seat is removably connectable with the torso support.

10. The apparatus of claim 9, wherein the seat comprises any selected one of a plurality of available seat configurations.

11. The apparatus of claim 1, wherein the connector comprises a first connector, wherein the accessory comprises:

a plurality of wheels that is employable by the caregiver for rolling support and transfer of the patient by the caregiver upon a location of the patient in the seat;

a second connector that at any selected height of a plurality of available heights is removably connectable with the first connector;

a platform that is employable to support one or more feet of the patient for and during transfer by the caregiver; and a tiltable support that is employable by the caregiver to move the patient between:

a seated position of the patient at the start location to a transport position of the patient, wherein the transport position of the patient is contemporaneous with substantially full support of the weight of the patient through the plurality of wheels relative to a floor as a load-bearing surface; and the transport position of the patient and the target location.

12. The apparatus of claim 1, wherein the connector comprises a first connector, wherein the accessory comprises:

a second connector that at any selected height of a plurality of available heights is removably connectable with the first connector; and a knee pad that is shaped to engage a knee of the caregiver and allow the caregiver to use the knee of the caregiver to assist with transfer of the patient from the start location to the target location, wherein the knee pad serves to at least in part support the weight of the patient relative to a knee of the caregiver as a load-bearing surface.

13. The apparatus of claim 1, wherein the connector comprises a first connector, wherein the accessory comprises:

a second connector that at any selected height of a plurality of available heights is removably connectable with the first connector;

an intermediate support coupled with the second connector; and a base coupled with the intermediate support;

a fastener coupled with the intermediate support, wherein the fastener is removably engagable with a bed frame;

wherein the accessory allows the patient to occupy a seated position at an edge of a bed as the start location or the target location.

14. The apparatus of claim 1, wherein the connector comprises a first connector, wherein the accessory comprises:

a rotary disk that is operably locatable on a floor as a load-bearing surface;

a second connector that at any selected height of a plurality of available heights is removably connectable with the first connector; and a tiltable support that is employable by the caregiver to move the patient to and from a transport position of the patient supported by the rotary disk, wherein the transport position of the patient is contemporaneous with substantially full support of the weight of the patient through the rotary disk relative to the load-bearing surface.

15. The apparatus of claim 14, wherein the tiltable support comprises a car that is by the caregiver selectively interfaceable with the load-bearing surface through operation by the caregiver;

wherein the rotary disk is employable by the caregiver contemporaneous with occupation by the patient of the transport position to promote a relatively low friction rotation of the patient for change of an orientation of the patient.

16. The apparatus of claim 1, wherein the connector comprises a first connector, wherein the accessory comprises:

a second connector that at any selected height of a plurality of available heights is removably connectable with the first connector;

an intermediate support coupled with the second connector; and a rockable base coupled with the intermediate support, wherein the rockable base as operated by the caregiver serves to at least in part support the weight of the patient relative to a floor as a load-bearing surface, wherein the rockable base comprises:

a curved surface that is rockable on the floor to promote employment of the accessory with the seat and/or the torso support to move the patient off a seated position at the start location and toward the target location for transfer of the patient; and a rotary disk mounted on the curved surface to provide a relatively low friction rotation upon the floor and operated by the caregiver to change an original orientation of the patient from the start location to rock in a transport orientation to the target location.

* * * * *